US010800559B2

(12) United States Patent
Hansen et al.

(10) Patent No.: US 10,800,559 B2
(45) Date of Patent: Oct. 13, 2020

(54) HORIZONTALLY ARRANGED WRAP PACKAGING SYSTEM

(71) Applicant: FRANK BRUHN APS, Broager (DK)

(72) Inventors: Niels Erik Hansen, Broager (DK); Frank Bruhn, Broager (DK)

(73) Assignee: FRANK BRUHN APS, Broager (DK)

( * ) Notice: Subject to any disclaimer, the term of this patent is extended or adjusted under 35 U.S.C. 154(b) by 453 days.

(21) Appl. No.: 15/524,139

(22) PCT Filed: Oct. 27, 2015

(86) PCT No.: PCT/DK2015/050327
§ 371 (c)(1),
(2) Date: May 3, 2017

(87) PCT Pub. No.: WO2016/070883
PCT Pub. Date: May 12, 2016

(65) Prior Publication Data

US 2017/0334586 A1 Nov. 23, 2017

(30) Foreign Application Priority Data

Nov. 4, 2014 (DK) ..... 2014 70675

(51) Int. Cl.
*B65B 11/00* (2006.01)
*B65B 9/14* (2006.01)
(Continued)

(52) U.S. Cl.
CPC ..... *B65B 11/004* (2013.01); *B65B 9/14* (2013.01); *B65B 35/10* (2013.01); *B65B 41/12* (2013.01);
(Continued)

(58) Field of Classification Search
CPC .. B65B 9/13; B65B 9/14; B65B 9/135; B65B 9/175; B65B 9/551; B65B 9/218; B65B 11/004; B65B 35/10; B65B 41/16; B65B 45/00; B65B 51/10; B65B 57/00; B65B 61/06; B65B 2011/002
(Continued)

(56) References Cited

U.S. PATENT DOCUMENTS 4,063,401 A * 12/1977 Higgins ..... B65B 9/135 53/567
5,024,042 A * 6/1991 Meyer ..... B65B 39/007 53/168
(Continued)

FOREIGN PATENT DOCUMENTS

DE 90 01 321 U1 4/1990
DE 201 01 909 U1 6/2002
(Continued)

OTHER PUBLICATIONS

International Search Report and Written Opinion for corresponding International Patent Application No. PCT/DK2015/050327 dated Jan. 21, 2016, 18 pages.

*Primary Examiner* — Dariush Seif
(74) *Attorney, Agent, or Firm* — Merchant & Gould P.C.

(57) ABSTRACT

There is provided a system for packaging objects on a conveyor using a hose-shaped stretch foil. More specifically, the invention provides a system, wherein the hose-shaped stretch foil can be wrapped around the objects in a horizontal manner.

6 Claims, 6 Drawing Sheets

(51) Int. Cl.

| | |
|---|---|
| ***B65B 43/04*** | (2006.01) |
| ***B65B 43/34*** | (2006.01) |
| ***B65B 41/12*** | (2006.01) |
| ***B65B 35/10*** | (2006.01) |
| ***B65B 41/16*** | (2006.01) |
| ***B65B 45/00*** | (2006.01) |
| ***B65B 51/10*** | (2006.01) |
| ***B65B 57/00*** | (2006.01) |
| ***B65B 61/06*** | (2006.01) |

(52) U.S. Cl.
CPC ..... *B65B 41/16* (2013.01); *B65B 43/04* (2013.01); *B65B 43/34* (2013.01); *B65B 45/00* (2013.01); *B65B 51/10* (2013.01); *B65B 57/00* (2013.01); *B65B 61/06* (2013.01); *B65B 2011/002* (2013.01); *B65B 2210/02* (2013.01)

(58) Field of Classification Search
USPC ..... 53/441, 577
See application file for complete search history.

(56) References Cited

U.S. PATENT DOCUMENTS 6,161,365 A * 12/2000 Girard ..... B65B 25/02 53/441
6,470,654 B1 * 10/2002 Lachenmeier ..... B65B 9/135 53/459
9,156,575 B2 * 10/2015 Potempa ..... B65B 7/06
9,352,867 B2 * 5/2016 Actis ..... B65B 5/045
10,011,377 B2 * 7/2018 Oyama ..... B65B 39/02
2004/0107677 A1 6/2004 Hannen et al.
2006/0053750 A1 * 3/2006 Petersen ..... B65B 9/135 53/441
2007/0220832 A1 * 9/2007 Dussault ..... B65B 9/14 53/441
2011/0258973 A1 * 10/2011 Czok ..... B65B 9/135 53/473
2013/0097976 A1 * 4/2013 Honegger ..... B65B 59/02 53/492
2014/0013714 A1 * 1/2014 Lachenmeier ..... B65B 9/18 53/459
2014/0137516 A1 5/2014 Lachenmeier et al.

FOREIGN PATENT DOCUMENTS

DE 10 2004 063 931 A1 1/2006
DE 20 2009 008 118 U1 12/2009
DE 102009024663 A1 * 12/2010 ..... B65B 9/13
DE 10 2011 075 451 A1 11/2012
EP 0 779 209 A1 6/1997
EP 1 419 966 A1 5/2004
EP 1 574 432 A1 9/2005
EP 1 818 261 A1 8/2007
GB 2 417 229 A 2/2006

* cited by examiner

HORIZONTALLY ARRANGED WRAP PACKAGING SYSTEM

This application is a National Stage Application of International Patent Application No. PCT/DK2015/050327, filed 27 Oct. 2015, which claims benefit of Serial No. PA 2014 70675, filed 4 Nov. 2014 in Denmark and which applications are incorporated herein by reference. To the extent appropriate, a claim of priority is made to each of the above disclosed applications.

FIELD OF THE INVENTION

The invention relates to a system for packaging objects on a conveyor using a hose-shaped stretch foil. More specifically, the invention provides a system, wherein the hose-shaped stretch foil can be wrapped around the objects in a horizontal manner.

BACKGROUND OF THE INVENTION

Stretch packaging aims to give protection to a stack of goods during transport against humidity and other environmental influences. The wrapping with a foil hood ensures stability to the packed goods.

Prior art systems are generally used for the purposes of wrapping up a product, which is arranged for the most part on a pallet, at least in part with a tubular film in a packaging machine. This serves to stabilize the product and to provide protection against the surroundings. The tubular film may be configured as a hood that is closed at the top or as a band that is open at the top and the bottom.

Prior art systems utilize a tubular film portion matching the size of the product and the systems basically unroll a portion of the film onto gathering fingers which are fastened to a frame. A gathering drive unit is then moved into contact with the tubular film portion such that an operative connection is created. By driving the gathering roller, the tubular film portion is gathered-up onto the individual gathering fingers such that a film store laid in folds is formed on the respective gathering finger. Once the tubular film portion has been gathered-up, the gathering fingers are driven in a substantially horizontal manner such that the tubular film portion is expanded or stretched. Expanding or stretching refers to a state where an elastic or elastic-plastic deforming of the tubular film occurs. The gathering fingers are then driven in a vertical manner along the product. At the same time the tubular film is released from the gathering fingers and the product is wrapped up therein as a result of the elastic resiliency of the tubular film portion.

Such systems are used for example in hood packaging installations. These may be installations which operate on the basis of what is known as the hood stretching process or the hood shrinking process. Both processes are distinguished by the fact that a portion of a tubular film is pulled or pushed over any desired cargo, or that the cargo is introduced into the portion of tubular film by means of a lifting table. This is referred to hereafter as wrapping of cargo.

In the case of most hood packaging installations, the portion of tubular film is first reefed by means of a reefing device, to then be slipped over the cargo by the reefing device or by a separate drawing-over device and thereby unreefed. During the reefing, a supply of portions of tubular film laid in folds, which is also referred to hereafter as a film store, is formed at the bottom of the reefing fingers. If the reefing device is also used for the drawing over, the reefing device is moved in relation to the cargo, possibly after stretching the portion of tubular film. During this relative movement, the portion of tubular film is pulled off from the reefing fingers, is also referred to as unreefed.

U.S. Pat. No. 5,024,042 discloses a system for packaging objects in hose-shaped foil which comprises a movable packaging frame having a plurality of horizontally arranged gripping arms for holding and stretching the foil, a conveyor for supporting objects and transporting it towards the packaging frame, so that the object is delivered between the gripping arms. U.S. Pat. No. 5,024,042 does not disclose gripping arms equipped with opposing and activated rollers and that a second conveyor is positioned next to the packaging frame, where the second conveyor transports the packaged object away from the packaging frame.

There is a need to improve the existing systems by reducing the size thereof and by decreasing the packaging time and complexity. In particular there is a need to improve the efficiency of packaging objects in hose-shaped enclosures.

SUMMARY OF THE INVENTION

The system according the present invention differs from the systems described above in that wrapping is achieved horizontally instead of vertically. Several technical features are essential to achieve horizontal wrapping and the system is characterized by a higher production cycle and hence a higher efficiency.

Thus, in a first aspect the present invention concerns system for packaging objects with a hose-shaped stretch foil, said system comprises:

- a movable packaging frame having a plurality of horizontally oriented gripping arms for holding and stretching the stretch foil, each gripping arm equipped with opposing and activated rollers which can be brought into contact with the stretch foil, whereby activation of the rollers enable the stretch foil to be gathered onto and ungathered from the gripping arms, said gripping arms being independently and laterally movable to achieve stretching of stretch foil;
- a first conveyor for supporting the object and transporting it toward the packaging frame so that the object is delivered between the gripping arms, said first conveyor transporting the object perpendicular to the packaging frame and in an axis parallel with the gripping arms;
- a second conveyor for supporting the object and transporting it away from the packaging frame, said second conveyor placed next to the packaging frame, which during the ungathering of the stretch foil is placed between the first and second conveyors, and oriented axially with the gripping arms;
- stretch foil storage and dispensing means for storing and dispensing a portion of hose-shaped stretch foil;
- a cutting device for cutting a predetermined portion of hose-shaped stretch foil, said cutting device being associated with the stretch foil storage and dispensing means—this is preferably achieved by either i) heating the open end in conjunction with an occlusion of the stretch foil, or ii) by sealing in any other way;
- optionally means for closing the open end of the portion of hose-shaped stretch foil that has been cut by the cutting device;
- a rail system for moving the packaging frame from the stretch foil storage and dispensing means to the area between the first and second conveyors; and
- a control unit.

The control unit is preferably programmed to execute the following steps:

- directing the packaging frame to the stretch foil storage and dispensing means, which dispenses a portion of hose-shaped stretch foil corresponding to the size of the object to packaged;
- activating the rollers of the gripping arms to gathering the stretch foil onto the gripping arms;
- directing the packaging frame to be placed between the first and second conveyors, whereby the gripping arms are positioned axially with the conveyors;
- activating the first conveyor to transport the object toward the packaging frame, wherein the object moves along and in between the gripping arms;
- activating the rollers of the gripping arms to ungather the stretch foil from the gripping arms and onto the object while the object moves away from the gripping arms towards the second conveyor; and
- activating the second conveyor to transport the packaged object away from the packaging frame.

In a particularly preferred embodiment the system includes an additional laterally movable packaging frame, which is preferably moveable on the same rail system as the above defined laterally movable packaging frame. Otherwise it moves on a separate rail system. The aim of an additional packaging frame is to be able to gather stretch foil on one packaging frame while the other packaging frame is ungathering and packaging the object to be packaged. The additional laterally movable packaging frame is therefore moving in the same plane as the above defined packaging frame. In order to gather stretch foil onto the gripping arms of the additional packaging frame an additional stretch foil storage and dispensing means is needed. Also an additional cutting device and optionally additional means for closing the open end of the portion of hose-shaped stretch foil that has been cut by the additional cutting device is needed.

In order to easier open the hose-shaped stretch foil a cone or pyramid shaped component fitting the opening of the hose-shaped stretch foil may be used in a preferred embodiment of the present invention.

In a second aspect of the present invention there is provided a method for packaging objects with a hose-shaped stretch foil with the system of the present invention. This method comprises the steps of:

- directing the packaging frame to the stretch foil storage and dispensing means, which dispenses a portion of hose-shaped stretch foil corresponding to the size of the object to packaged;
- activating the rollers of the gripping arms to gathering the stretch foil onto the gripping arms;
- moving the gripping arms to achieve stretching of stretch foil and providing a space between the gripping arms that allows for passage of the object to be packaged;
- directing the packaging frame to be placed between the first and second conveyors, whereby the gripping arms are positioned axially with the conveyors;
- activating the first conveyor to transport the object toward the packaging frame, wherein the object moves along and in between the gripping arms;
- activating the rollers of the gripping arms to ungather the stretch foil from the gripping arms and onto the object while the object moves away from the gripping arms towards the second conveyor; and
- activating the second conveyor to transport the packaged object away from the packaging frame.

In a third aspect there is provided a modified gripping arm for holding and stretching the stretch foil in the above mentioned first and second aspect of the invention as well as in other systems for packaging objects with a hose-shaped stretch foil. The modified gripping arm is able to prevent any undesired disrupture and folding of stretch foil when it is gathered or ungathered to and from the gripping arm.

Such a gripping arm is shown in FIGS. 5 and 6 and is equipped with opposing and activated rollers which can be brought into contact with the stretch foil, whereby activation of the rollers enable the stretch foil to be gathered onto and ungathered from the gripping arm. The modified gripping arm is configured with activated rollers (5', 5") that support a movable belt (5*a*) which can be brought into contact with the stretch foil (4), whereby activation of the rollers (5', 5") and thereby the belt (5*a*) enable the stretch foil to be gathered onto the gripping arm when the activated roller (5') is tilted towards an opposing roller (5*b*') remote from the front end of the gripping arm and enable stretch foil to be ungathered from the gripping arm when the activated roller (5") is tilted towards an opposing roller (5*b*") in the front end of the gripping arm.

DETAILED DESCRIPTION OF THE INVENTION

Figure 1:
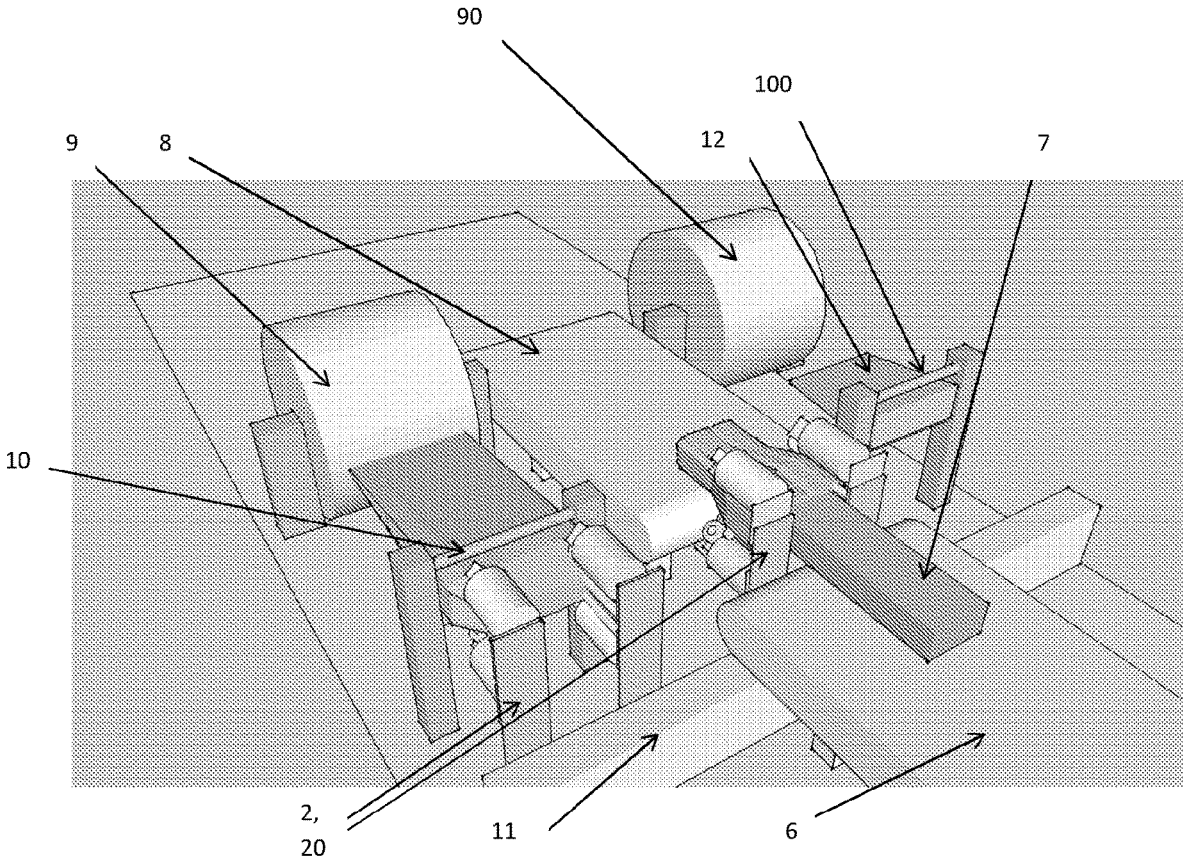
FIG. 1 shows a perspective view of the system.

Identical components are given the same designations in the text which follows and are provided with the same reference signs in the drawings.

Figure 2:
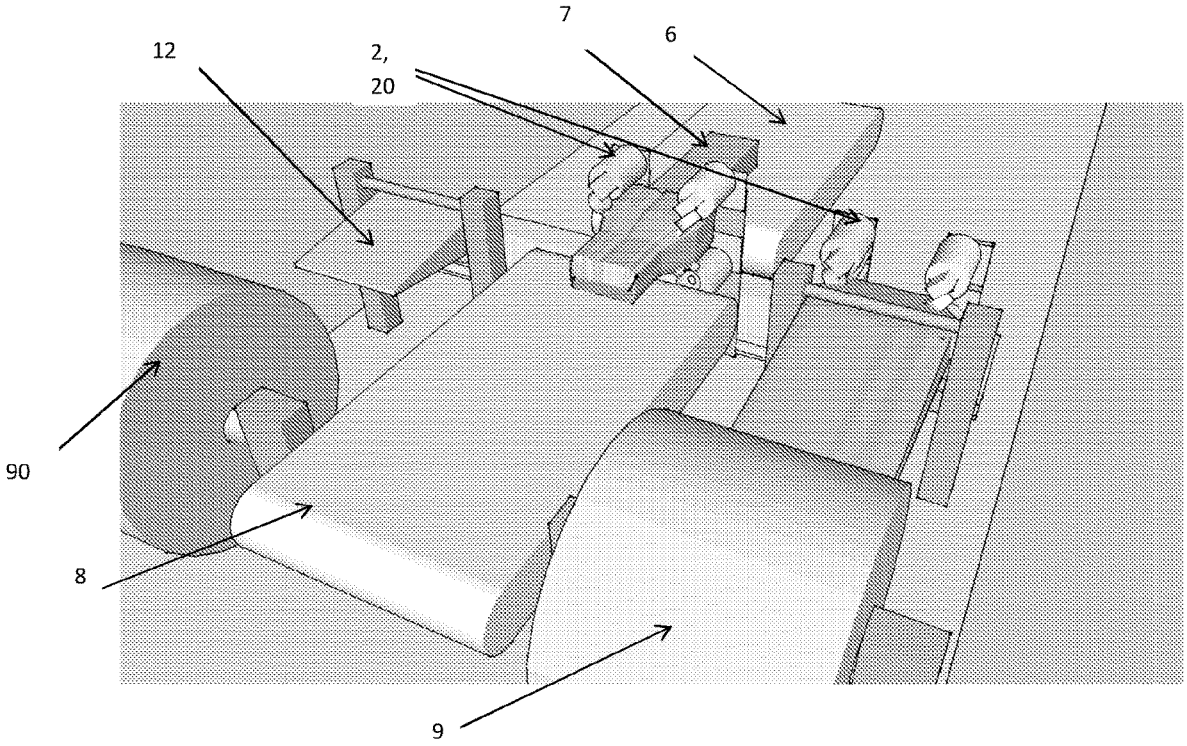
FIG. 2 shows the embodiment from FIG. 1 in another perspective view.
Figure 3:
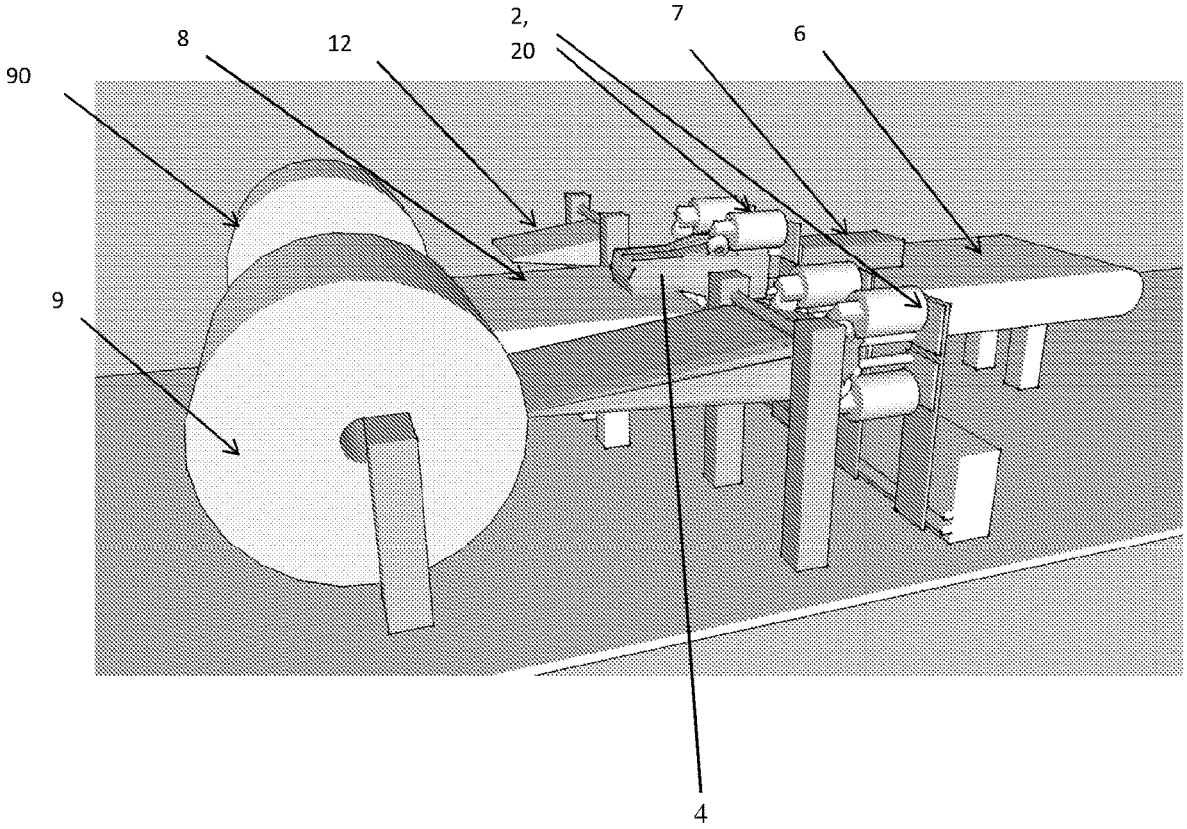
FIG. 3 shows the embodiment from FIG. 1 in a third perspective view.

The exemplary embodiment of a system according to the invention that is shown in FIGS. 1-3 comprises four gripping arms (3) that are arranged on a frame (2, 20) and can be individually activated, with in each case an assigned drive unit.

In FIGS. 1-3 are shown views of the movable packaging frame (2, 20) having four horizontally oriented gripping arms (3) for holding and stretching the stretch foil (4). The rail system (11) is used for moving the packaging frame (2, 20) from the stretch foil storage and dispensing means (9, 90) to the area between the first (6) and second (8) conveyors. In the shown embodiment two packaging frames (2, 20) and two stretch foil storage and dispensing means (9, 90) are provided; in such a configuration one of the packaging frames may be gathering stretch foil while the other is ungathering stretch foil onto the object to packaged.

Each gripping arm (3) is equipped with opposing and activated rollers (5) which can be brought into contact with the stretch foil (4), whereby activation of the rollers (5) enable the stretch foil (4) to be gathered onto and ungathered from the gripping arms (3). The gripping arms (3) are independently and laterally movable to achieve stretching of foil (4). There is shown a first conveyor (6) for supporting the object (7) and transporting it toward the packaging frame (2, 20) so that the object (7) is delivered between the gripping arms (3). This first conveyor (6) transports the object (7) perpendicular to the packaging frame (2, 20) and in an axis parallel with the gripping arms (3). The second conveyor (8), which is placed next to the packaging frame (2, 20), supports the object (7) and transports it away from the packaging frame (2, 20).

FIG. 3 shows the stretch foil storage and dispensing means (9, 90) for storing and dispensing a portion of hose-shaped stretch foil (4). In the embodiment shown the cutting device (10, 100) is designed to cut a predetermined portion of hose-shaped stretch foil (4). The cone-shaped device (12) is used to facilitate the opening of the hose-shaped stretch foil (4).

The grippers (3) have a fixedly mounted roller (5), which engage with a complementary roller that can be activated by a drive unit. Each drive unit has a motor that drives and activates the roller. In the case of the exemplary embodiment shown here, the first and second conveyors (6, 8) are configured to transport the objects (7) to be packaged.

Figure 4:
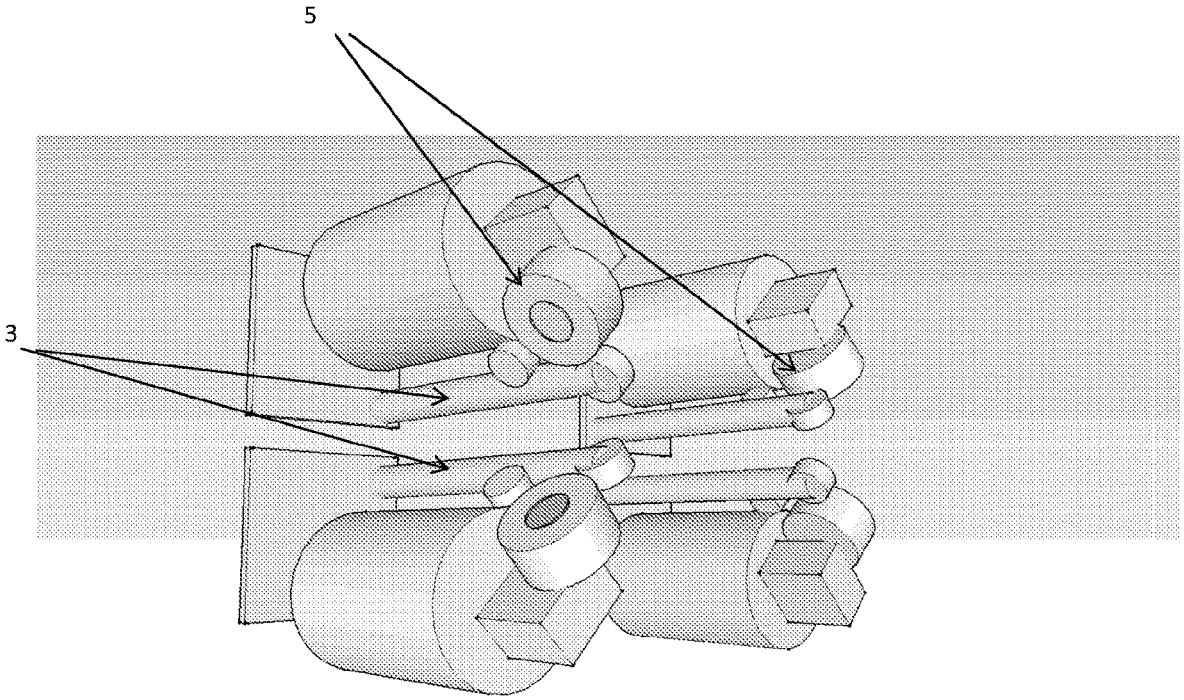
FIG. 4 shows a detailed view of the gripping arms.

In the case of the gripping arms (3) that are shown in FIG. 4, apart from the fixedly but rotatably attached roller the gripping arms have a further opposing roller, which can be activated by a motor.

FIG. 1-3 show the gripping arms (3) in a step in which a portion of stretch foil has already been pushed over the grippers and, after that, the four gripping arms are moved in a position between the first (6) and second conveyor (8) before the gripping arms (3) are spread apart. Consequently, the rollers (5) that are fixedly mounted at the ends of the gripping arms are already in contact with the inner side of the portion of stretch foil (4).

FIG. 4 shows in more detail the gripping arms (3). As shown in FIGS. 1-4 engagement is created between the activated rollers and the fixedly attached rollers the objects to be packaged move from the first conveyor (6) to the second conveyor (8) and through the opening of the stretch foil (4) established between the arms (3). When the object (7) to be packaged enters the opening of the hose-shaped stretch foil (4) the activated rollers start to unwind the film while the good moves to the second conveyor thereby covering the object (7) with the stretchable foil (4).

Figure 5:
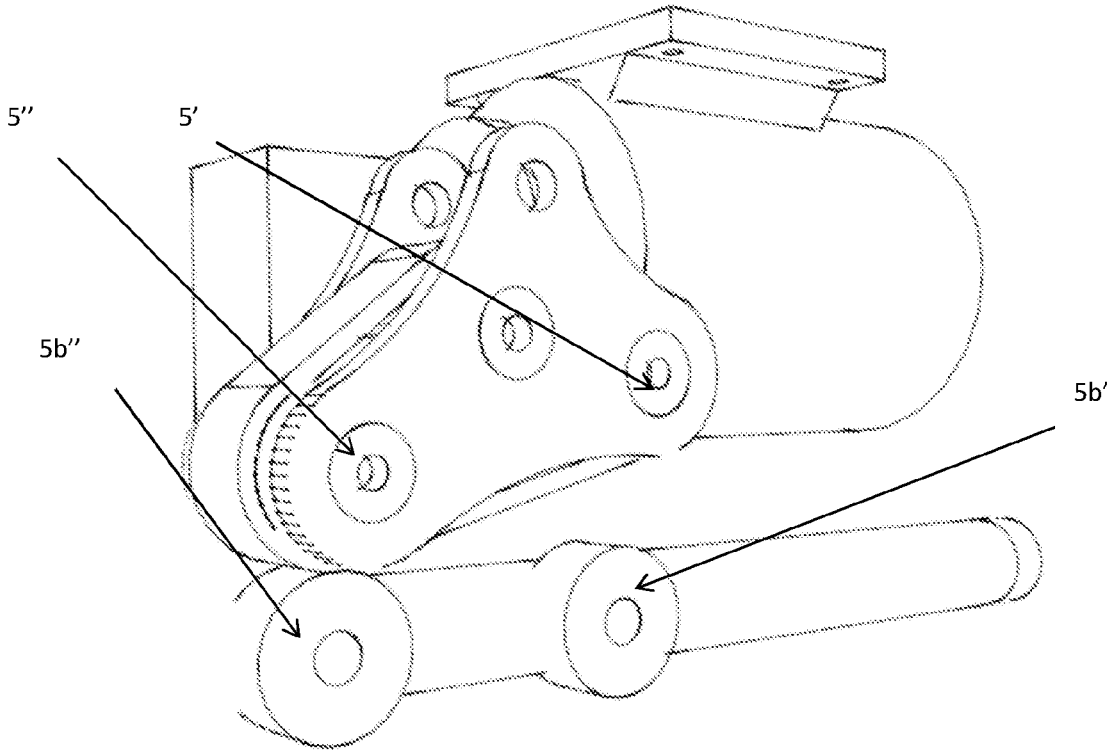
FIG. 5 shows a detailed view of a modified gripping arm gathering stretch foil onto the gripping arm.
Figure 6:
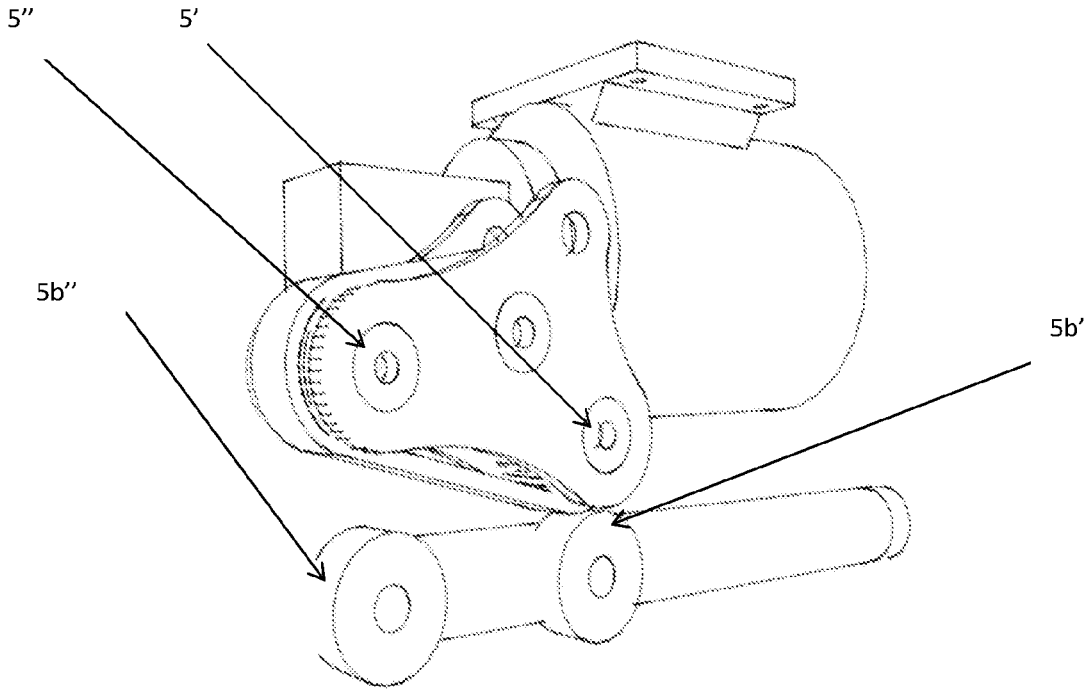
FIG. 6 shows a detailed view of a modified gripping arm ungathering stretch foil from the gripping arm.

Referring to FIG. 5 there is shown a detailed view of a modified gripping arm gathering stretch foil onto the gripping arm. Referring to FIG. 6 there is shown a detailed view of the modified gripping arm ungathering stretch foil from the gripping arm. Specifically, the gripping arm is configured with activated rollers (5', 5") that support a movable belt which can be brought into contact with the stretch foil (4), whereby activation of the rollers (5', 5") and thereby the movable belt enable the stretch foil to be gathered onto the gripping arm when the activated roller (5') is tilted towards an opposing roller (**5*b*') remote from the front end of the gripping arm (cf FIG. 5) and enable stretch foil to be ungathered from the gripping arm when the activated roller (5") is tilted towards an opposing roller (5*b*") in the front end of the gripping arm (cf FIG. 6**).

According to the invention, the cylinders, such as pneumatic cylinders or other actuator, used to move the grippers in the system can be activated separately. Generally, only a relatively small cylinder stroke is necessary.

The invention claimed is:

1. A system for packaging objects with a hose-shaped stretch foil, said system comprises:

a movable packaging frame having a plurality of horizontally oriented gripping arms for holding and stretching the stretch foil, each gripping arm equipped with opposing and activated rollers which can be brought into contact with the stretch foil, whereby activation of the rollers enable the stretch foil to be gathered onto and ungathered from the gripping arms, said gripping arms being independently and laterally movable to achieve stretching the of stretch foil;

a first conveyor for supporting an object and transporting it toward the packaging frame so that the object is delivered between the gripping arms, said first conveyor transporting the object perpendicular to the packaging frame and in an axis parallel with the gripping arms;

a second conveyor for supporting the object and transporting it away from the packaging frame, said second conveyor placed next to the packaging frame, which during the ungathering of the stretch foil is placed between the first and second conveyors, and oriented axially with the gripping arms;

stretch foil storage and dispensing means for storing and dispensing a portion of hose-shaped stretch foil;

a cutting device for cutting a predetermined portion of hose-shaped stretch foil, said cutting device being associated with the stretch foil storage and dispensing means;

a rail system for moving the packaging frame between the stretch foil storage and dispensing means and the area between the first and second conveyors; and a control unit;

wherein activation of the activated rollers enables the stretch foil to be gathered onto the gripping arms when the activated rollers are tilted toward opposing rollers remote from the front end of the gripping arms, and enables the stretch foil to be ungathered from the gripping arms when the activated rollers are tilted toward opposing rollers in the front end of the gripping arms.

2. The system according to claim 1 further comprising means for closing the open end of the portion of hose-shaped stretch foil that has been cut by the cutting device.

3. The system according to claim 1, wherein the control unit is programmed to execute the following steps:

directing the packaging frame to the stretch foil storage and dispensing means, which dispenses a portion of hose-shaped stretch foil corresponding to the size of the object to packaged;

activating the rollers of the gripping arms to gathering the stretch foil onto the gripping arms;

directing the packaging frame to be placed between the first and second conveyors, whereby the gripping arms are positioned axially with the conveyors;

activating the first conveyor to transport the object toward the packaging frame, wherein the object moves along and in between the gripping arms;

activating the rollers of the gripping arms to ungather the stretch foil from the gripping arms and onto the object while the object moves away from the gripping arms towards the second conveyor; and activating the second conveyor to transport the packaged object away from the packaging frame.

4. The system according to claim 1, wherein closing the open end of the portion of hose-shaped stretch foil is achieved by heating the open end in conjunction with an occlusion of the stretch foil.

5. The system according to claim 1, wherein an additional laterally movable packaging frame is provided laterally and moveable on the rail system, and an additional stretch foil storage and dispensing means for storing and dispensing a portion of hose-shaped stretch foil for the additional movable packaging frame;

an additional cutting device for cutting a predetermined portion of hose-shaped stretch foil, said additional cutting device being associated with the additional stretch foil storage and dispensing means;

optionally additional means for closing the open end of the portion of hose-shaped stretch foil that has been cut by the additional cutting device whereby one of the packaging frames may be gathering stretch foil onto its gripping arms while the other packaging frame packages an object by ungathering stretch foil thereto.

6. The system according to claim 1, wherein the stretch foil storage and dispensing means include a cone or pyramid shaped component fitting the opening of the hose-shaped stretch foil for opening the stretch foil before being transferred onto gripping arms.

* * * * *